US007461490B2

(12) United States Patent
Toledo

(10) Patent No.: US 7,461,490 B2
(45) Date of Patent: Dec. 9, 2008

(54) CONSTRUCTION BLOCK SYSTEM

(76) Inventor: Omar Toledo, 5800 W. 15 Ct., Hialeah, FL (US) 33012

( * ) Notice: Subject to any disclaimer, the term of this patent is extended or adjusted under 35 U.S.C. 154(b) by 480 days.

(21) Appl. No.: 10/870,583

(22) Filed: Jun. 18, 2004

(65) Prior Publication Data

US 2005/0257480 A1 Nov. 24, 2005

Related U.S. Application Data

(63) Continuation-in-part of application No. 10/349,250, filed on Jan. 23, 2003, now Pat. No. 6,763,644.

(51) Int. Cl.
*E04B 5/04* (2006.01)

(52) U.S. Cl. ..... 52/605; 52/293.2; 52/293.3

(58) Field of Classification Search ..... 52/598, 52/604, 605, 562, 564, 568, 293.2, 293.3, 52/586.1, 586.2
See application file for complete search history.

(56) References Cited

U.S. PATENT DOCUMENTS 2,019,653 A * 11/1935 Buyer ..... 52/592.5
2,688,245 A * 9/1954 Vesper ..... 52/592.5
3,888,060 A * 6/1975 Haener ..... 52/284
4,565,043 A * 1/1986 Mazzarese ..... 52/592.6
5,024,035 A * 6/1991 Hanson et al. ..... 52/591.1
5,159,795 A * 11/1992 Colen ..... 52/564
5,775,047 A * 7/1998 Jensen ..... 52/596
5,960,604 A * 10/1999 Blanton ..... 52/604
6,082,067 A 7/2000 Bott
6,138,426 A * 10/2000 Mork et al. ..... 52/562
6,665,992 B2 * 12/2003 Hew ..... 52/562
6,763,644 B1 * 7/2004 Toledo ..... 52/592.6
7,007,436 B1 * 3/2006 Kelley ..... 52/605

* cited by examiner

*Primary Examiner*—Richard E Chilcot, Jr.
*Assistant Examiner*—Jessica Laux
(74) *Attorney, Agent, or Firm*—Sanchelima & Assoc P.A.

(57) ABSTRACT

A construction block system that includes a block with slanted edges that coact with contiguous blacks to define spaces or grooves for receiving cementitious substances. Cooperatively aligned channels in the upper and lower edges coact with longitudinally extending walls perpendicularly mounted to a base assembly. An adjustable mechanism provides for leveling of the base assembly to ensure proper installation of the lowermost row of blocks. Subsequently rows are aligned and leveled with a leveling tool assembly that is also partially received within the cooperative channels.

4 Claims, 6 Drawing Sheets

CONSTRUCTION BLOCK SYSTEM

OTHER RELATED APPLICATIONS

The present application is a continuation-in-part of allowed and of U.S. patent application Ser. No. 10/349,250, filed on Jan. 23, 2003 now U.S. Pat. No. 6,763,644, which is hereby incorporated by reference.

BACKGROUND OF THE INVENTION

1. Field of the Invention

The present invention relates to a construction block system and accessories, and more particularly, to a construction block system that can be readily aligned during installation with predictable dimensions for the resulting structure.

2. Description of the Related Art

Many designs for construction block systems have been designed in the past. None of them, however, includes upper and lower channels cooperatively disposed to receive aligning members therein. Nor do they include external edge cutouts for lodging the cements. Conventional blocks are aligned manually. And the separations between blocks are responsible for unpredictable overall dimensions of the resulting wall structures and also resulting in misalignment.

Applicant believes that another related reference corresponds to U.S. Pat. No. 6,082,067 issued to Tim Allen Bott on Jul. 4, 2000 for dry stackable block structures. Bott's stackable block structure system for dry stacking concrete reinforced walls, includes a stretcher block with a recess of triangular cross-section on the bottom surface and disposed intermediate a pair of co-planar, parallelly disposed laterally extending rectangular edge portions. The top surface of the block includes a flat portion in the center and two edge portions forming upwardly converging surfaces of truncated triangular cross-section. Notches (33; 34 and 35) are disposed at a midpoint of the webs (31;32 and 30, respectively) and have a semi-circular cross sectional configuration to receive a horizontally disposed reinforcing bar are provided to allow concrete to engage the rebar at the ends of the block structure. However, even if the Bott's patent mentions that "horizontally disposed reinforcing rods may be positioned between courses and received in notches 33-35", it does not disclose a system as claimed herein. The separations between abutting blocks are also created when cement is applied.

None of the prior art blocks includes external horizontal edge cutouts to receive the cement to avoid the creation of separations between abutting blocks and upper and lower channels. Also, the present invention includes the use of block aligning accessories, such as the base alignment tool and row leveling and reinforcement tool cooperative received by the block lower and upper channels, to permit a user to keep a wall structure aligned throughout its construction. These features are not suggested in the prior art references.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a construction block system that allows a user to readily align and level contiguous blocks without separation in-between to form wall structures.

It is another object of this invention to provide a block system that includes external longitudinal edge cutouts for receiving cement without creating a separation between abutting blocks.

Another object of this invention is to provide a block system that includes channels in the upper and lower surfaces of the block's transversal walls to receive aligning tools.

It is still another object of this invention to provide a block system that allows a user to readily build wall structures with consequent savings of time.

It is still another object of this invention to provide a block system that can be readily assembled and disassembled without requiring specialized tools or substantial previous training or experience.

It is yet another object of this invention to provide such a system that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A, 1B:
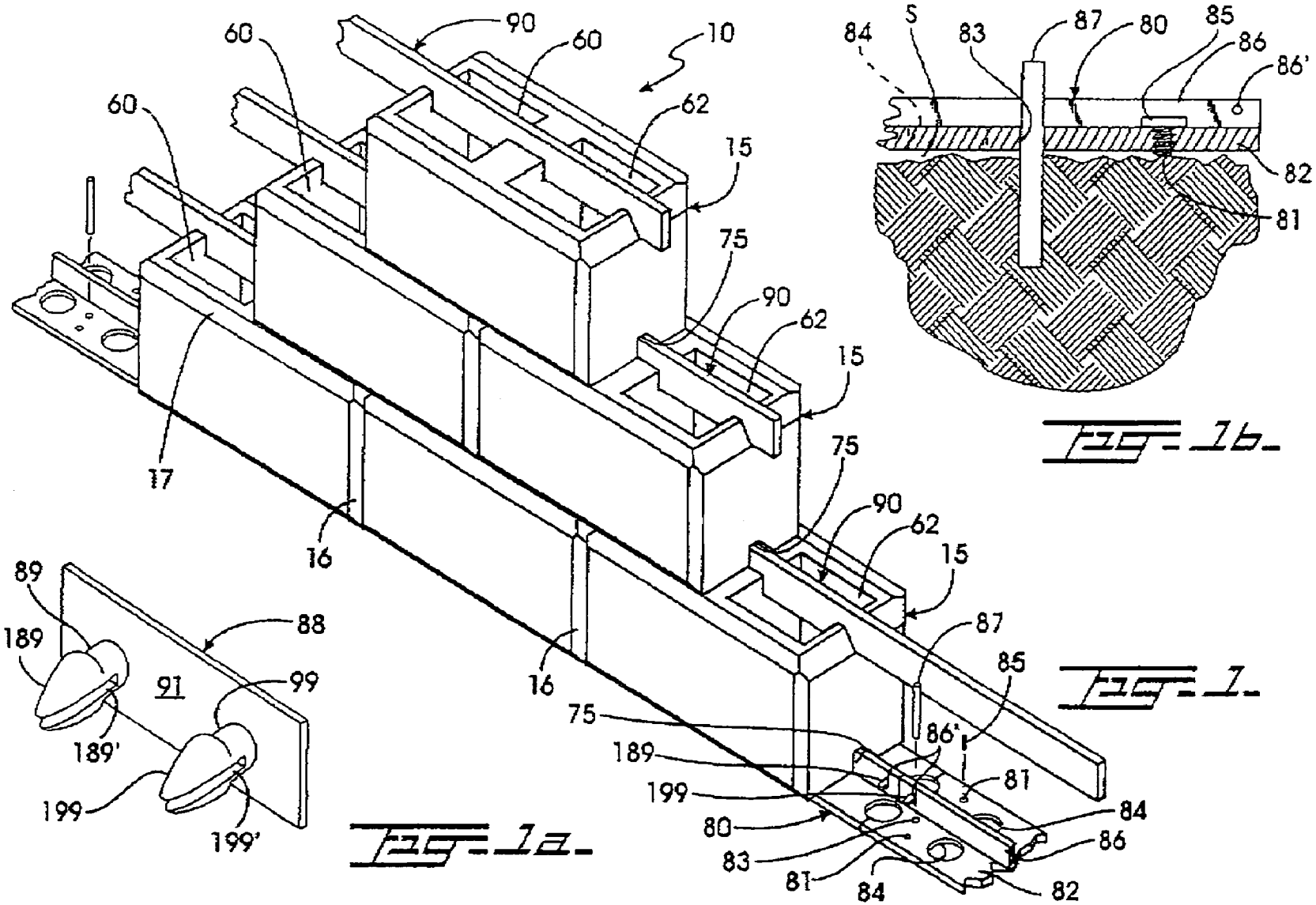
FIG. 1 is an isometric view of a wall structure being built using the present invention where the first row of blocks is placed on the base alignment assembly and the row leveling and reinforcement assembly is mounted on contiguous subsequent rows.
FIG. 1*a* represents an isometric enlarged view of one of the preferred embodiments for the securing plate joining sections of the base alignment tool assembly shown in FIG. 1.
FIG. 1*b* shows a partial detailed cross-sectional elevational view of the base alignment tool assembly showing the screw and pin members cooperatively mounted to horizontally align the assembly.
Figure 3:
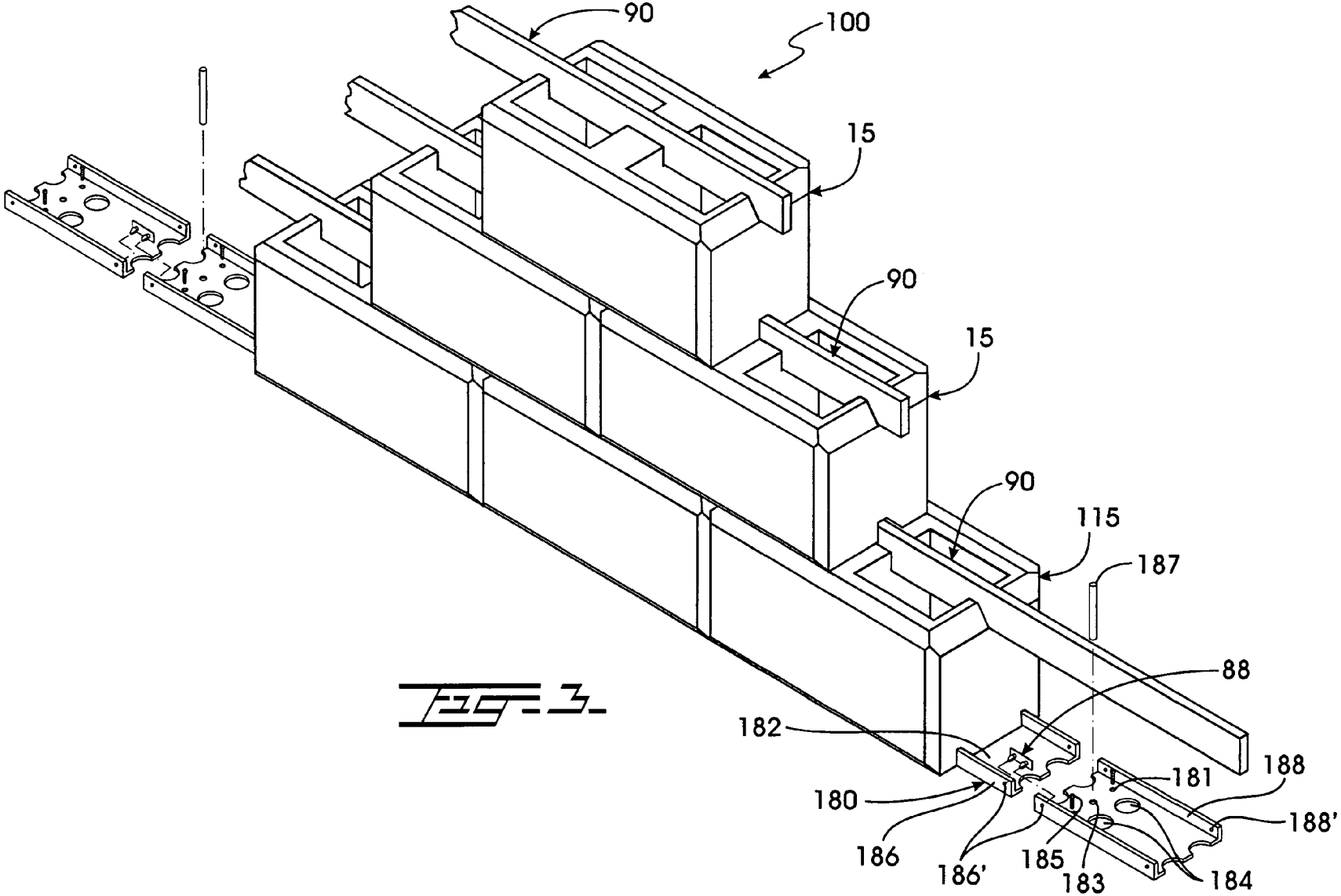
FIG. 3 is an isometric view of a wall structure being built using an alternate embodiment for the present invention where the base alignment assembly includes two guiding walls and the base block includes two lower channels on each of its transversal walls.

Referring now to FIG. 1, where the present invention is generally referred to with numeral 10, it can be observed that it basically includes block 15, base alignment tool and row leveling assembly 80 and reinforcement tool assembly 90. An alternate embodiment 100 is shown in FIG. 3 with base block 115 and block 15 with alternate base alignment tool assembly 180.

Figure 2:
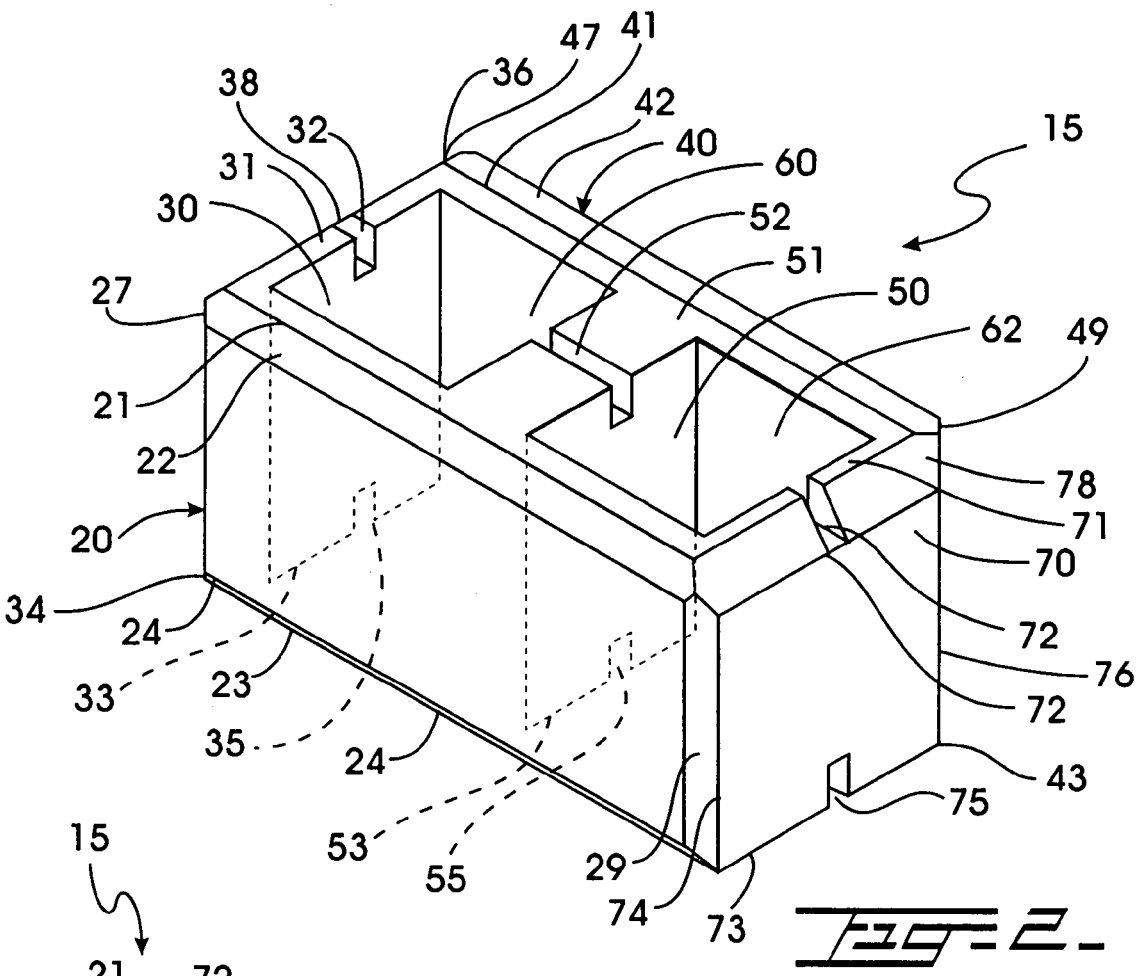
FIG. 2 represents an isometric view of one of the preferred embodiments for the construction block, used in the system object of the present application.

As best seen in FIG. 2, block 15 includes longitudinal walls 20 and 40 and transversal walls 30, 50 and 70. Longitudinal walls 20 and 40 are disposed at a parallel and spaced apart relationship with respect to each other and perpendicularly with respect to transversal walls 30, 50 and 70. Walls 20 and 40, 30, 50 and 70 define internal cavities 60 (between walls 30 and 50) and 62 (between walls 50 and 70). Block 15 also includes upper edges 21 and 41 of longitudinal walls 20 and 40, respectively, that terminate with upper slanted walls 22 and 42. Walls 20 and 40 also include side edges 34 and 74, for wall 20, and side edges 36 and 76, for wall 40, that extend perpendicularly from upper edge 21 and lower edge 23; upper edge 41 and lower edge 43, respectively. Side edges 34; 36; 74 and 76 include side edge slanted walls 27; 29; 47 and 49. Side edge slanted walls 27 and 29 (for wall 20) extend vertically. In the same way, side edge slanted walls 47 and 49 (for wall 40) extend vertically. Side edge slanted walls 27, 29, 47 and 49, form vertical grooves 16 when abutting blocks 15 are positioned in the same row to receive the cementitious substance typically used to keep blocks together.

Figure 2A:
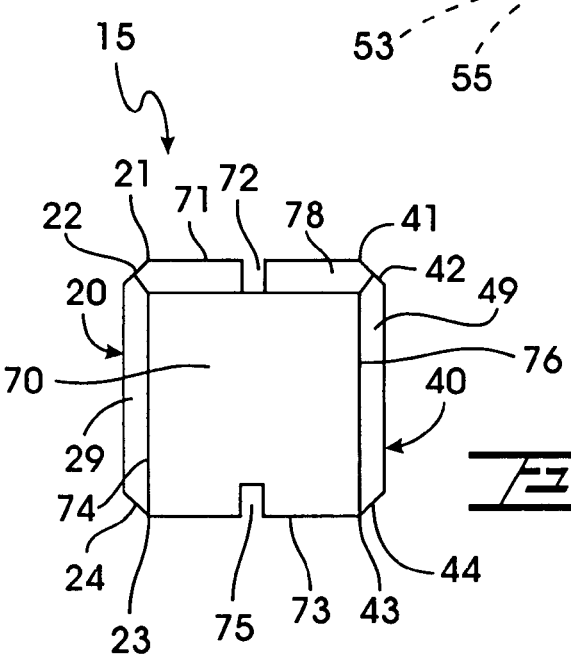
FIG. 2A is an end elevational view of the block represented in FIG. 2.

Block 15 also has lower edges 23 and 43 of longitudinal walls 20 and 40, respectively, that terminate with lower slanted walls 24 and 44, as best seen in FIG. 2A. Upper slanted walls 22 and 42 of vertically contiguous blocks form longitudinal grooves 17 that receive the cementitious substance when at least two rows of blocks are completed.

As best seen in FIG. 2, transversal walls 30, 50 and 70 include upper edges 31, 51 and 71, respectively. Upper edge 31 includes upper slanted wall 38 and channel 32. Similarly, upper edge 51 includes channel 52 and upper edge 71 includes upper slanted wall 78 and upper channel 72. Channels 32, 52 and 72 are longitudinally aligned and cooperatively receive row leveling and reinforcement tool assembly 90. Transversal walls 30, 50 and 70 also include lower edges 33, 53 and 73, respectively. Lower edge 33 includes channel 35. Similarly, lower edge 53 includes channel 55 and lower edge 73 includes channel 75. Channels 35; 55; 75 are longitudinally aligned. As best seen in FIG. 1, channels 35; 55; 75 of the base row of blocks 15 receive guiding wall 86, of base alignment tool assembly 80.

As shown in FIG. 1, base alignment tool assembly 80 is a base tool for horizontally aligning the lowermost row of blocks 15. Base alignment tool assembly 80, also permits a user to level the base when the footing (or horizontal surface that is supporting assembly 80) has irregularities. Base alignment tool assembly 80 includes longitudinally extending sheet 82 with perpendicularly mounted guiding wall 86. Guiding wall 86 includes through openings 86', at its longitudinal ends. Guiding wall 86 is cooperatively positioned to be inserted into channels 35, 55 and 75. Sheet 82 includes through threaded openings 81, in the preferred embodiment, disposed along the entire length of sheet 82 and adjacent to the longitudinal edges of sheet 82. Through openings 83 are also disposed along the entire length of sheet 82. Through openings 84 are cooperatively disposed in vertical alignment with cavities 60 and 62.

As best seen in FIG. 1*b*, through openings 81 cooperatively and selectively receive screw members 85, or fastening similar members. Screw members 85 level base alignment tool assembly 80 when horizontal leveling is required. Additionally, pin members 87 pass through openings 83 on individual sheets 82. Pin members 87 cooperatively fix base alignment tool assembly 80 to a substantially horizontal supporting surface avoiding any lateral movement of the latter while the user is leveling it with screw members 85. Through openings 83 receive pin members 87 therethrough. Once base alignment tool assembly 80 is aligned with pin member 87 and screw members 85 and the first row of block 15 is installed, cavities 60 and 62 are filled up with a light cementitious substance that goes through openings 84 to seal any open spaces under base alignment tool assembly 80.

Base alignment tool assembly 80 also includes securing plate 88 with headed pin members 89 and 99 perpendicularly mounted to surface 187, as seen in FIG. 1*a*. Headed pin members 89 and 99 include, in the preferred embodiment, bifurcated heads 189 and 0.199 with slits 189' and 199', respectively, to provide a resilient action to each head half portion. Longitudinally extending sheet 82 may have different dimensions. Depending on the required dimensions of the wall to be built, more than one longitudinally extending sheet 82 are used. To lockingly secure two adjacent sheets 82 the user aligns them, mounting plates 88 to contiguous ends of guiding walls 86 and mounting headed pin members 89 and 99 to guiding wall 86 by passing the former through openings 86'.

As best seen in FIG. 1, row leveling and reinforcement tool assembly 90 is, in the preferred embodiment, a straight elongated rigid member. Row leveling and reinforcement tool assembly 90 is partially received by channels 32; 52; 72; 35; 55 and 75 of adjacent blocks 15, to facilitate the vertical and horizontal alignment of the rows. Row leveling and reinforcement tool assembly 90 also provide reinforcement to the wall structure by interlocking the adjacent blocks in a same row and the blocks in the adjacent rows. Row leveling and reinforcement tool assembly 90 has a substantially elongated rectangular shape with cooperative dimensions to be receivable by upper longitudinally aligned channels 32,52 and 72, as well as longitudinally aligned lower channels 35; 55 and 75 of blocks 15.

Figure 4:
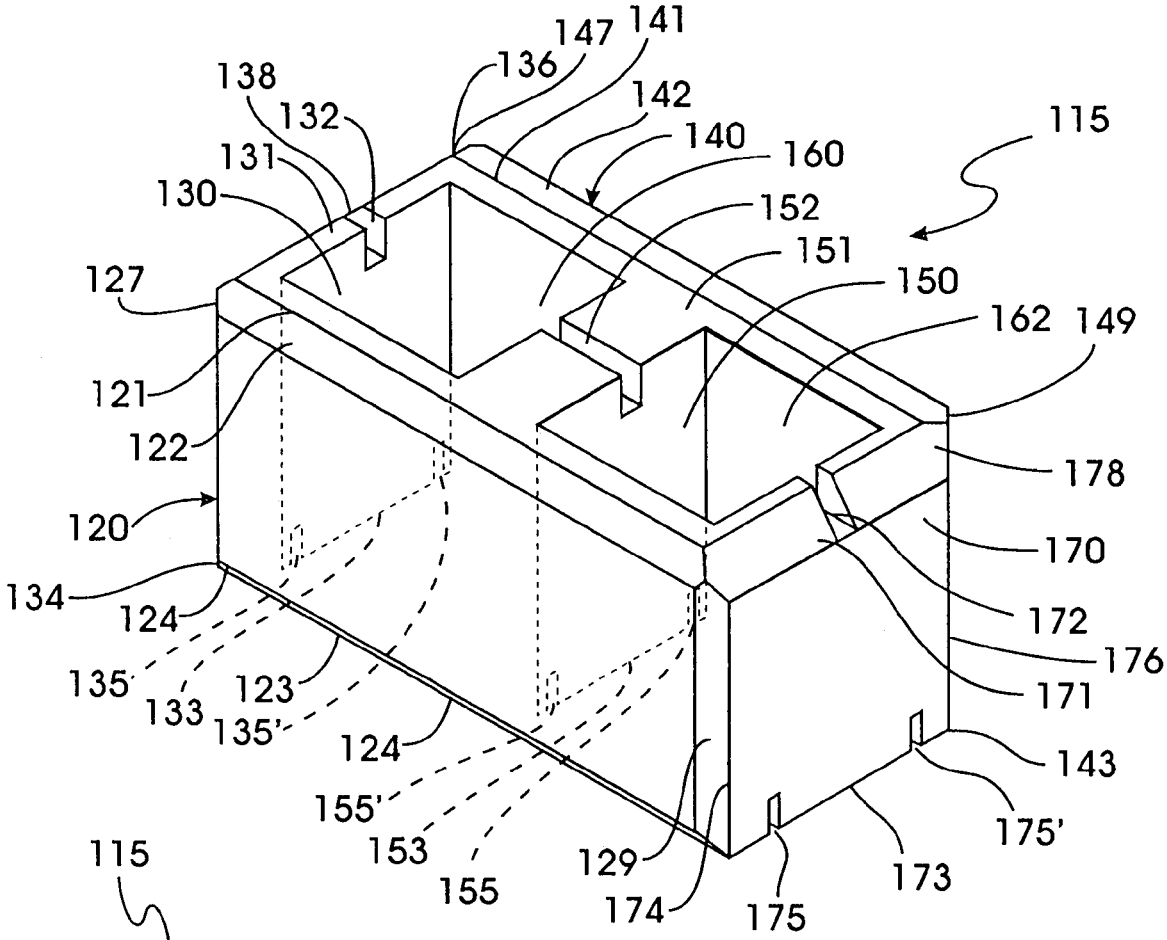
FIG. 4 represents an isometric view of a base block used with the alternate embodiment shown in FIG. 3.
Figure 4A:
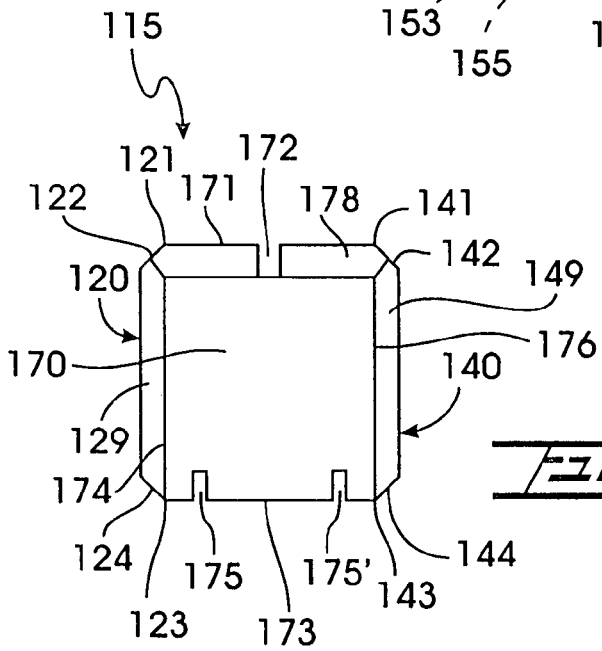
FIG. 4*a* is an end elevational view of the base block represented in FIG. 4.

An alternate construction block system embodiment is referred to with numeral 100 and is represented in FIG. 3. Construction block system 100 includes base alignment tool assembly 180 with two guiding walls (186 and 188) and construction block 115. Blocks 115 are installed in the base (first) row with base alignment tool 180. As best seen in FIGS. 4 and 4A, block 115 has substantially the same shape and dimensions as block 15 with longitudinal walls 120 and 140 and transversal walls 130, 150 and 170, defining internal cavities 160 (between walls 130 and 150) and 162 (between walls 150 and 170). Block 115 has upper edges 121 and 141 for walls 120 and 140, respectively, that terminate with upper slanted walls 122 and 142. Also, lower edges 123 and 143 for walls 120 and 140, respectively, terminate with lower slanted walls 124 and 144, as best seen in FIG. 4*a*. Walls 120 and 140 also include side edges 134 and 174, for wall 120, and side edges 136 and 176, for wall 140, that extend perpendicularly from edges 121 and 123; 141 and 143 respectively. Side edges 134; 136; 174 and 176 include side edge slanted walls 127; 129; 147 and 149. Side edge slanted walls 127 and 129 (for wall 120) extend vertically and perpendicularly to upper edge 121. In the same way, side edge slanted walls 147 and 149 (for wall 140) extend vertically and perpendicularly to upper edge 141. Walls 127, 129, 147 and 149, form vertical grooves when abutting blocks 115 are positioned in the same row to receive a cementitious substance typically used to keep blocks together.

As best seen in FIG. 4, transversal walls 130, 150 and 170 include upper edges 131, 151 and 171, respectively. Upper edge 131 includes upper slanted wall 138 and channel 132. Similarly, upper edge 151 includes channel 152 and upper edge 171 includes upper slanted wall 178 and upper channel 172. Channels 132, 152 and 172 are longitudinally aligned and receive row leveling and reinforcement tool assembly 90. Transversal walls 130, 150 and 170 also include lower edges 133, 153 and 173, respectively. As represented in FIG. 4, lower edge 131 includes channels 135 and 135'. Similarly, lower edge 153 includes channels 155 and 155' and lower edge 173 includes channels 175 and 175'. Longitudinally aligned channels 135, 155 and 175 of block 115 receive guiding wall 186 and longitudinally aligned channels 135', 155' and 175' receive guiding wall 188 of base alignment tool assembly 180, therein.

FIG. 3 shows an alternate embodiment for base alignment tool assembly 180 including two guiding walls 186 and 188. Similar to base alignment tool assembly 80, base alignment tool assembly 180 is a base tool for horizontally aligning the lowermost row of blocks 115. Base alignment tool assembly 180 includes longitudinally extending sheet 182 with perpendicularly mounted guiding walls 186 and 188. Guiding walls 186 and 188 are at a parallel and spaced apart relationship with respect to each other. Guiding walls 186 and 188 includes through openings 186' and 188', respectively, at their longitudinal ends. Sheet 182 has a cooperative width so guiding walls 186 and 188 be inserted into channels 135, 155, 175 and 135', 155', 175', respectively of block 115. Sheet 182 includes through openings 181, in the preferred embodiment, disposed along the entire length of sheet 182 and adjacent to guiding walls 186 and 188, through openings 183, also disposed along the entire length of sheet 182 and at its center, and through openings 184 cooperatively disposed so four openings 184 are positioned within the position each cavity 160 and 162. Through openings 183 cooperatively and selectively receive screw members 185 for cooperative alignment of tool assembly 180 when required. Additionally, pin members 187 pass the through openings 183 next to the ends of sheet 182. Pin members 187 cooperatively fix base alignment tool assembly 180 avoiding any lateral movement of the latter while the user is leveling it with screw members 185. Through openings 183 receive pin members 187 only in the event that sheet 120 is cut.

Similar to base alignment tool assembly 80, two base alignment tool assemblies 180 are secured to each other with securing plate 88. To lockingly secure two adjacent sheets 182 the user aligns them, mounting plates 88 to contiguous ends of guiding walls 186 and 188 and mounting headed pin members 89 and 99 to guiding walls 186 and 188 by passing the former through openings 186' as well as through openings 188'.

Figure 5:
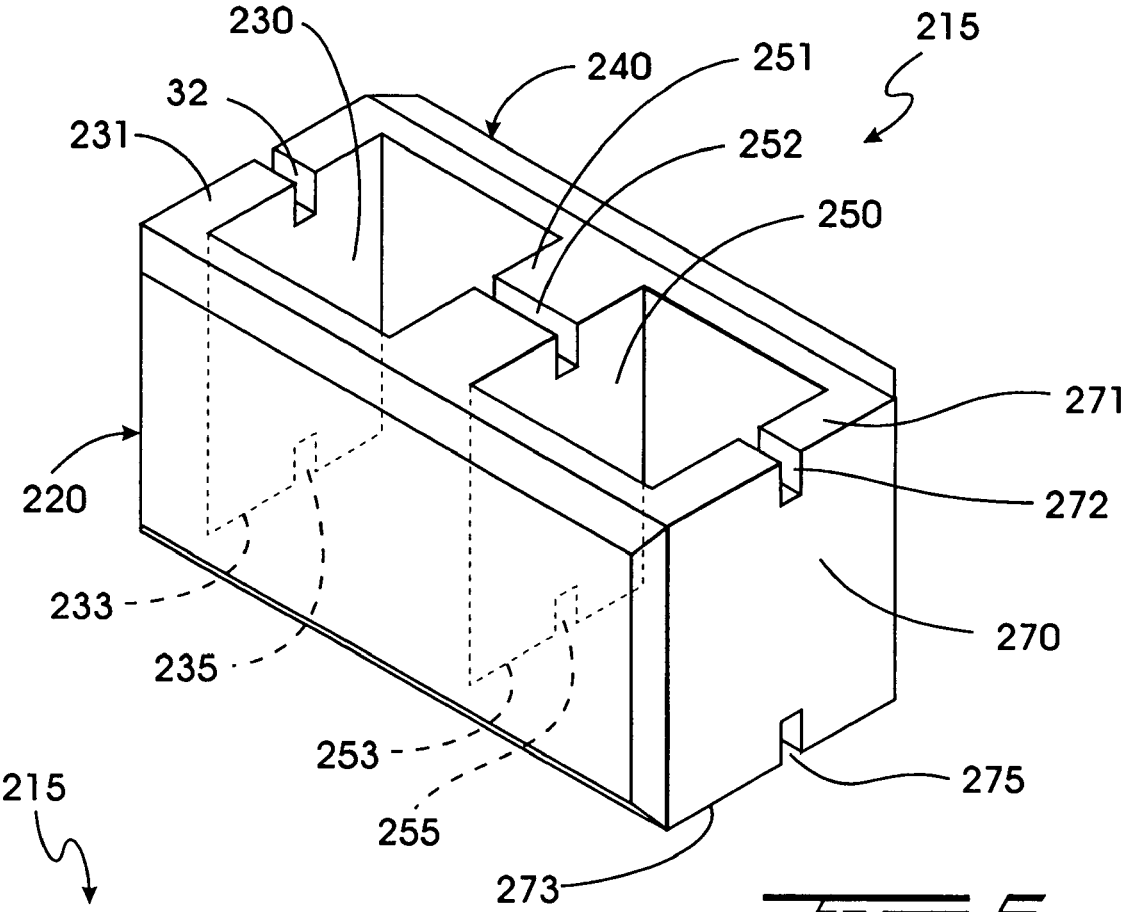
FIG. 5 illustrates an isometric view of another of the preferred embodiments for the construction block, used in the system represented in FIG. 1 and also used in the alternate system shown in FIG. 3 as other than the base block. This embodiment does not include upper transversal slanted walls.
Figure 5A:
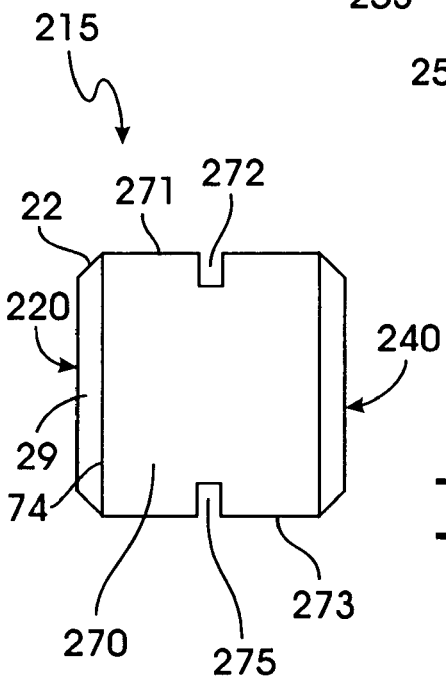
FIG. 5A is an end elevational view of the block represented in FIG. 5.

Still another construction block embodiment is referred to with numeral 215 and is shown in FIGS. 5 and 5*a*. Construction block 215 has the same configuration of block 15 with longitudinal walls 220 and 240 and transversal walls 230, 250 and 270. Construction block 215 includes upper slanted walls 238 and 278 on upper edges 231 and 271, respectively. Similarly to block 15, upper edge 231 includes channel 232, upper edge 251 includes channel 252 and upper edge 271 includes upper channel 272 to cooperatively receive row leveling and reinforcement tool assembly 90. Channels 231; 151 and 271 are longitudinally aligned. Lower edges 233; 253 and 273 include longitudinally aligned channels 235; 255 and 275, respectively. Channels 235; 255; 275 of the base row of blocks 215 receive guiding wall 86, of base alignment tool assembly 80. Channels 235; 255; 275 of rows of blocks 215, other than the base row, receive leveling tool assembly 90 therein.

Figure 6:
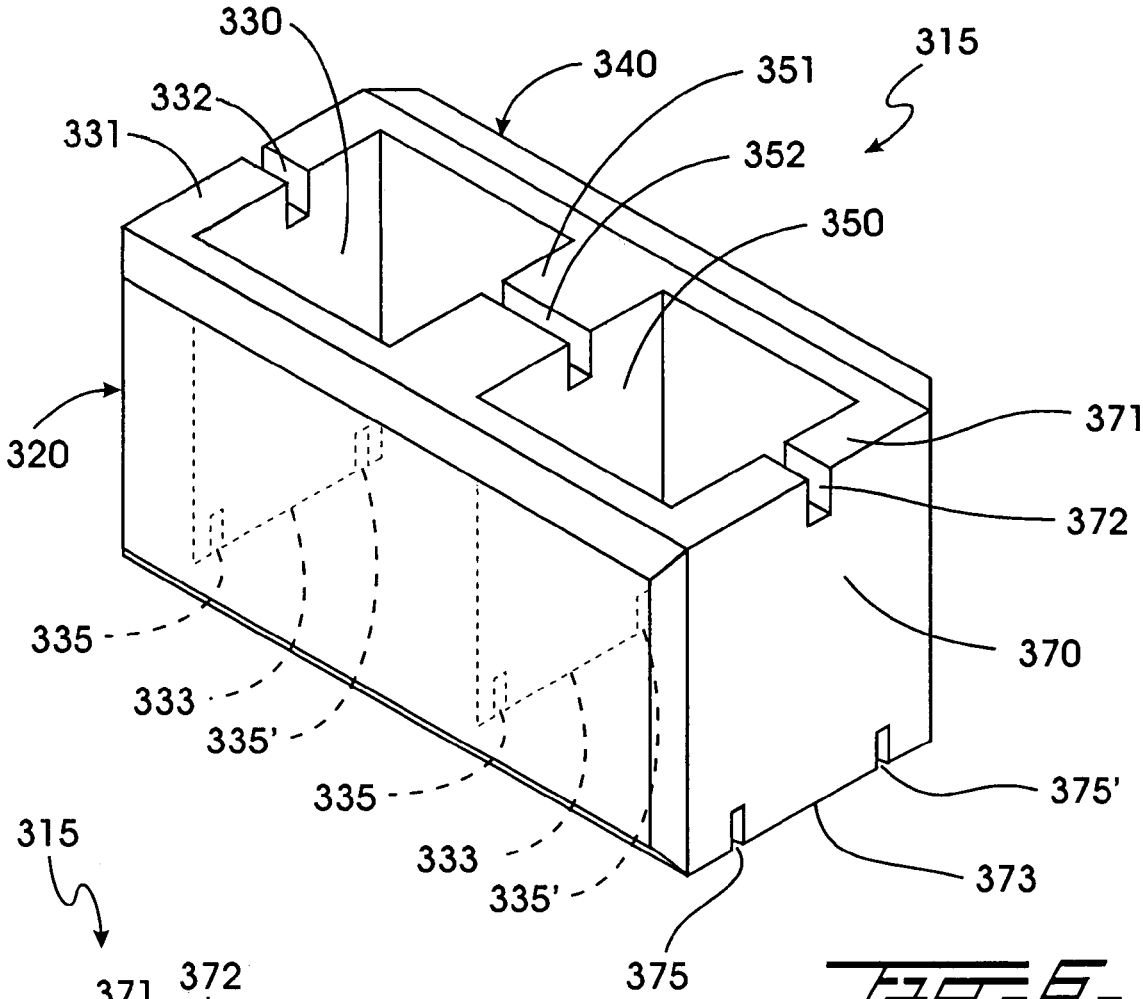
FIG. 6 represents an isometric view of yet another embodiment for a base block, used in the system without the upper transversal slanted walls.
Figure 6A:
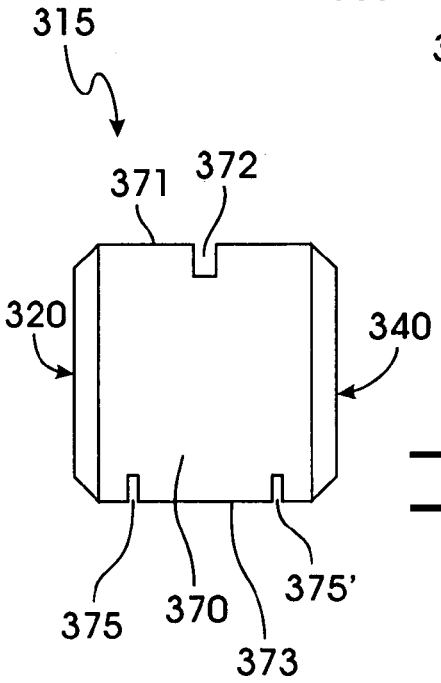
FIG. 6*a* is an end elevational view of the base block represented in FIG. 6.

Yet another construction block embodiment is referred to with numeral 315 and is shown in FIGS. 6 and 6*a*. Construction block 315 has the same configuration of block 115 with longitudinal walls 320 and 340 and transversal walls 330, 350 and 370. Construction block 315 includes upper slanted walls 338 and 378 on upper edges 331 and 371, respectively. Similarly to block 115, upper edge 331 includes channel 332, upper edge 351 includes channel 352 and upper edge 371 includes upper channel 372 to cooperatively receive row leveling and reinforcement tool assembly 90. Channels 331; 351 and 371 are longitudinally aligned. Lower edge 333 includes channels 335 and 335', lower edge 353 includes channels 355 and 355' and lower edge 373 includes channels 375 and 375'. Channels 335, 355 and 375 of block 315 are longitudinally aligned and receive guiding wall 186 and channels 335', 355' and 375' are longitudinally aligned and receive wall 188 of base alignment tool assembly 180, therein.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A construction block system including a block comprising:

A) first and second walls kept at a parallel and spaced apart relationship with respect to each other and including first and second, upper and lower edges, said first and second upper edges including first and second upper slanted walls, and each of said first and second walls further including first and second side edges that extend perpendicularly from said first and second, upper and lower edges, and said first and second side edges include first and second side edge slanted walls and said first and second lower edges including first and second lower slanted walls;

B) third and fourth walls kept at a parallel and spaced apart relationship with respect to each other and connected to said first and second walls to form a block with a substantially rectangular cross-section, and each of said third and fourth walls including third and fourth upper and lower edges, respectively, said third and fourth walls being perpendicularly mounted to said first and second walls, said third and fourth upper edges each including at least one longitudinally aligned first channel, and said third and fourth lower edges including at least one longitudinally aligned second channels; and C) a base alignment tool assembly including at least one longitudinally extending sheet, said at least one longitudinally extending sheet including a plurality of through openings disposed along the entire length of said at least one longitudinally extending sheet, wherein said at least one longitudinally extending sheet includes means for horizontally leveling said at least one longitudinally extending sheet, said base alignment tool assembly further including at least one guiding wall perpendicularly mounted to said at least one longitudinally extending sheet, said at least one guiding wall having cooperative dimensions to be receivable within said at least one Longitudinal aligned second channel of the lowermost row of blocks of a wall structure to keep said blocks in alignment;

D) a plurality of vertical grooves defined by said first and second side edge slanted walls of horizontally contiguous blocks;

E) at least one longitudinal groove defined by said upper and lower slanted walls of vertically contiguous blocks; and F) a cementitious substance lodged in said grooves.

2. The block system set forth in claim 1 further including:

G) a fifth wall having fifth upper and lower edges said fifth wall being perpendicularly mounted between said first and second walls at predetermined distances from said third and fourth walls defining first and second internal cavities and said fifth wall further including fifth upper and lower edges having third and fourth channels, respectively, longitudinally aligned with said at least one first and second channels, respectively.

3. The block system set forth in claim 1 further including:

H) a row leveling and reinforcement tool assembly including at least one straight elongated rigid member partially receivable within said at least one first and third longitudinal aligned channels and within said at least one second and fourth channels, except for said blocks forming the lowermost row.

4. The block system set forth in claim 3 wherein said third and fourth walls include third and fourth upper slanted external walls, that coact with contiguous horizontally disposed blocks defining a space for lodging cementitious substance.

* * * * *